US005226273A

United States Patent [19]

Burke

[11] Patent Number: 5,226,273

[45] Date of Patent: Jul. 13, 1993

[54] OVERLAY BRICK DECK SYSTEM

[76] Inventor: Jonathan W. Burke, 8693 Guilford Rd., Columbia, Md. 21046

[21] Appl. No.: 745,693

[22] Filed: Aug. 16, 1991

[51] Int. Cl.[5] ..... E04F 13/14

[52] U.S. Cl. ..... 52/390; 52/388; 52/315; 52/73; 52/318

[58] Field of Search ..... 52/408, 390, 384–388, 52/318, 315, 601, 602, 309.3, 598, 332, 392, 391, 73

[56] References Cited

U.S. PATENT DOCUMENTS

| | | | |
|---|---|---|---|
| 1,675,093 | 6/1928 | Conley | 52/602 |
| 2,130,911 | 9/1938 | Teuron | 52/315 |
| 2,308,650 | 1/1943 | Desagnat | 52/388 |
| 3,209,500 | 10/1965 | Bernett | 52/390 |
| 3,521,418 | 7/1970 | Bartoloni | 52/318 |
| 3,740,911 | 6/1973 | O'Leary | 52/391 |
| 3,845,593 | 11/1974 | Zen | 52/602 |
| 3,863,417 | 2/1975 | Franchi | 52/741 |
| 3,868,801 | 3/1975 | Weiner | 52/315 |
| 3,950,908 | 4/1976 | Van Eyk | 52/598 |
| 4,005,954 | 2/1977 | Hinsche et al. | 52/744 |
| 4,238,914 | 12/1980 | Omholt | 52/309.3 |
| 4,507,901 | 4/1985 | Carroll | 52/332 |
| 4,809,470 | 3/1989 | Bauer et al. | 52/387 |
| 4,888,930 | 12/1989 | Kelly | 52/408 |
| 4,925,342 | 5/1990 | Hendy | 52/169.14 |
| 4,945,697 | 8/1990 | Ott et al. | 52/396 |
| 4,947,600 | 8/1990 | Porter | 52/309.12 |

*Primary Examiner*—Carl D. Friedman
*Assistant Examiner*—Winnie Yip
*Attorney, Agent, or Firm*—Morton J. Rosenberg; David I. Klein

[57] ABSTRACT

An overlay brick deck system (10) is provided which includes a base surface formed of slat members (20). A liquid pervious layer (24) is sandwiched between an upper surface (22) of slat members (20) and a lower rim surface (34) of brick or tile members (26). The brick or tile members (26) include a hollowed out under portion defining an internal chamber (32) which lessens the weight of individual brick or tile members (26) into an acceptable range for deck use purposes. Brick or tile members (26) are mounted adjacent each to the other and include recesses (36) at least partially filled with granulated composition (38). In this manner, there is provided an overlay brick deck system (10) which upon exposure to an external environment extends the useful working life of a deck over that of commercially available wooden deck systems. Additionally, with the use of hollowed out brick or tile members 26, aesthetically pleasing arrangements and designs may be provided far in excess of those designs of known wooden decks.

21 Claims, 3 Drawing Sheets

OVERLAY BRICK DECK SYSTEM

BACKGROUND OF THE INVENTION

1. Field of the Invention

This invention relates to deck structure systems. In particular, this invention relates to overlay brick or tile deck systems which are aesthetically pleasing. Still further, this invention relates to overlay brick deck systems wherein the useful life of the deck system may be enhanced and extended over prior known wooden decking structures. Still further, this invention provides for an overlay brick deck system which is structurally secure and able to accept high force bearing loads during use. More in particular, this invention relates to an overlay brick deck system which is formed in layers of elements. Additionally, this invention directs itself to an overlay brick deck system which utilizes a wooden slat member base surface having adhesively attached a liquid pervious layer positioned in overlying relation with respect to the deck base surface. Still further, this invention relates to an overlay brick deck system having a plurality of brick members positionally located substantially adjacent each to the other and in overlying relation with respect to the liquid pervious layer. In overall combination, this invention relates to an overlay brick deck system where a liquid pervious layer is sandwiched between a deck base surface and a plurality of brick members positionally located adjacent each to the other and where the liquid pervious layer is adhesively secured to both the deck base surface and the brick or tile members. Still further, this invention directs itself to an overlay brick deck system where individual brick or tile members are hollowed out in order to minimize the weight of the totality of brick or tile elements on the base surface.

2. Prior Art

Deck systems for domestic and/or commercial edifices are known in the art. Such deck systems and structures formed of wood are commonly used in both commercial and domestic utilizations as attachments to the basic edifice. However, in such prior wooden deck structures, the wooden structures have a low useful lifetime, due to the fact that wood deteriorates when exposed to the external environment. Additionally, such wooden structures are expensive to maintain due to the fact that the wood has to be treated periodically in order to maintain its aesthetic appearance and structural integrity.

In such prior art wooden structures, the wood to have an increased lifetime must be effectively protected by sealing on all sides at the time of installation, which greatly increases the cost of such prior art wood decks. Additionally, even where it has been found economical to seal the treated lumber at the time of installation, it has been found that such sealing is incomplete and thus, deterioration of the wooden members continues until the structure is no longer aesthetically pleasing.

A number of prior art systems are known to the Applicant, with the best prior art including U.S. Pat. Nos. 2,130,911; 2,266,510; 3,740,910; 3,868,801; 3,560,315; 4,947,600; 4,610,568; 3,521,418; 3,649,424; 1,754,253; 4,809,470; 4,507,901; 4,313,775; 4,888,930; 4,528,787; 4,589,804; 4,925,342; and 4,924,648.

In some prior art, such as that shown in U.S. Pat. No. 2,130,911, there are base members which are formed of differing materials such as plasterboard or fiberboard. On top of these base surfaces are spaced elements which are some type of pre-formed natural stone or cement. Such prior art provides for a combination of a wood type layer and a bricklike layer, however, such does not provide for geosynthetic materials or water pervious materials being sandwiched therebetween which allows for passage of the moisture, thereby providing a significant increase in the lifetime of the subject invention system. Additionally, such prior art systems do not concern themselves with the problem of water passage through the overall system and thus does not include a granulated material which allows moisture to pass therethrough.

In other prior art structures such as that shown in U.S. Pat. No. 2,266,510, there are provided building materials which include a base formed of a material such as a precast body of cellular gypsum or cellular cement. Such prior art structures do use a material of a fibrous nature such as Cellotex or pressed wood pulp. Once again, such prior art systems do not provide for the liquid pervious layer or geosynthetic fabric in that the members sandwich a cementitious material. Additionally, in such prior art systems, there is no provision for lowering the combined weight load of brick or tile elements which is provided in the subject invention concept system for the purposes and objectives as herein described.

SUMMARY OF THE INVENTION

An overlay brick deck system is provided which includes a deck base surface. A liquid pervious layer is positionally located in overlying relation with respect to the deck base surface. Additionally, a plurality of brick members are located substantially adjacent each to the other in overlying relation with respect to the liquid pervious layer.

An object of the subject invention concept system is to provide an improved deck system that is structurally and aesthetically superior when taken with respect to prior known deck systems.

A further object of the subject invention concept system is to provide a deck system which has a useful life greater than those of known prior art deck systems.

A still further object of the subject invention concept is to provide a deck system which may be integrated in an aesthetically pleasing manner to an attached edifice.

Another object of the subject invention concept system is to provide an improved deck system which is formed of layers of elements located in interfacing relation which is adaptable for long working life during exposure to the external environment with little or no maintenance required.

Another object of the subject invention system is to provide an improved deck system which is substantially maintenance free throughout its working life.

DESCRIPTION OF THE PREFERRED EMBODIMENTS

Referring now to FIGS. 1–6, there is shown overlay brick deck system 10 for providing an aesthetically pleasing improved deck system for domestic or commercial use. Overlay brick deck system 10 described in the following paragraphs provides for a low cost maintenance deck system which has an extended lifetime over commonly used wooden decks common in the marketplace. Brick or tile deck system 10 provides for a combination of wood and other material compositions in combined relation to protect underlying wood from fading effects of the sun and other harsh deteriorating effects applied by the external environment. In overall respect, overlay brick or tile deck system 10 increases the useable life of known wooden deck systems.

Additionally, due to the fact that the user may choose different aesthetically variational brick or tile members in the construction of overlay brick deck system 10, the deck system may then be integrated with the decor of an associated building or fixed structure which would enhance the aesthetic qualities of the overall structure.

Figure 1:
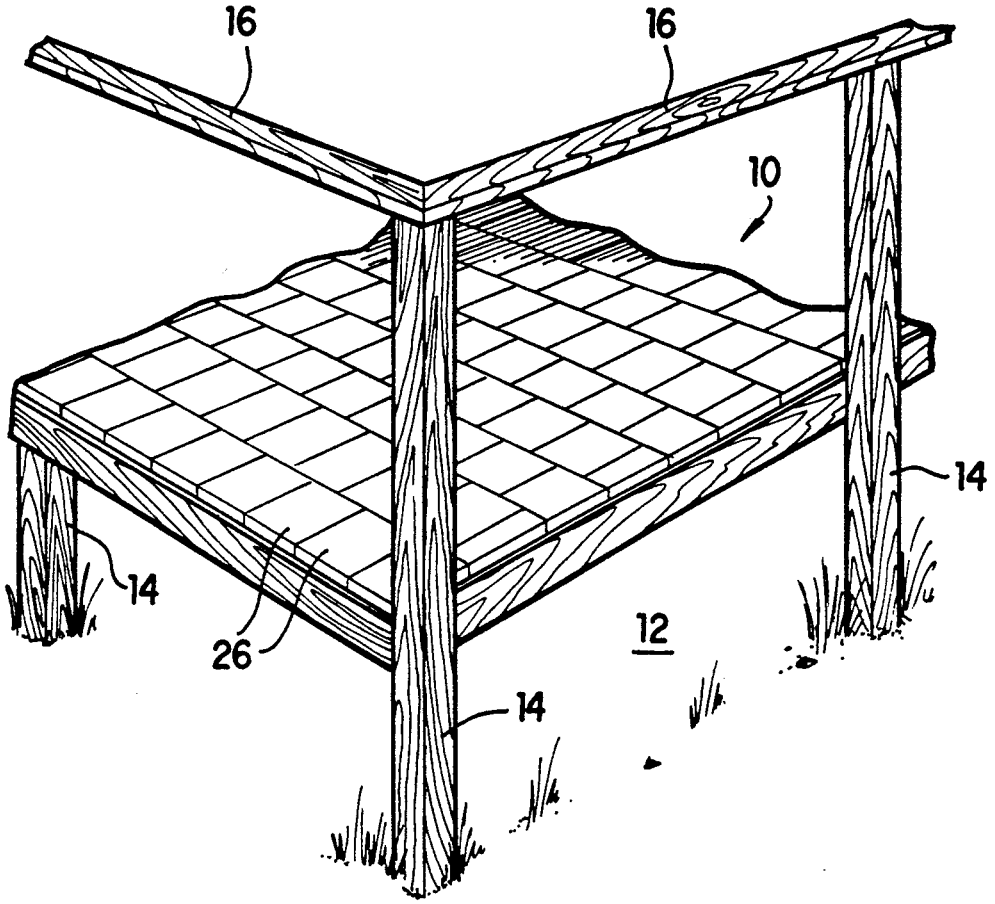
FIG. 1 is a perspective view of the overlay brick deck system partially in cut-away.

Overlay brick deck system 10 as shown in FIG. 1 may be supported on ground 12 through a plurality of vertically directed support or post members 14, as shown. Overlay brick deck system 10 may be securely mounted to vertically directed support or post members 14 through bolting, nailing, or some like technique, not important to the inventive concept as herein described, with the exception that overlay brick deck system 10 be structurally mounted in an accommodating manner to support members 14 to provide a brick deck system 10 which is structurally secure and able to accept the loads applied. Vertically directed support members 14 may be secured at upper ends to hand rail members 16 commonly provided in deck systems. Both support or post members 14 and rail members 16 may be compositionally formed of treated wood or some like material, known in the prior art.

Referring to FIGS. 2, and 4–6, there is shown a deck base surface having side slats 18 and slat members 20. Slat members 20 may be formed of a cellulose composition such as wood or some like material composition. Each of wooden slat members 20 has an upper surface 22 which when adjacent slat members 20 are mounted next to each other, forms the envelope of a substantially horizontal plane. Side slats 18 and slat members 20 may be treated to enhance their useable life when exposed to the external environment. Secured to wooden slat member upper surface 22 is liquid pervious layer 24 shown in FIGS. 2, and 4–6. Liquid pervious layer 24 is secured to wooden slat member upper surfaces 22 through use of adhesive bonding compounds, or some like securement method, not important to the inventive concept as herein described, with the exception that liquid pervious layer 24 is securely positioned to wooden slat member upper surfaces 22. The particular adhesive to be used may include a neoprene modified adhesive or a silicone composition adhesive.

Additionally, liquid pervious layer 24 may be adhesively secured to brick members 26 in order to provide a firm structural support. Layer 24 is bonded to brick member lower rim surface 34, thus leaving a spacing between individual brick members 26 to permit drainage therethrough.

Liquid pervious layer 24 is provided to maintain structural stability of overlay brick deck system 10 and while simultaneously allowing moisture to pass therethrough. Thus, where overlay brick deck system 10 is exposed to the external elements, water is able to pass through liquid pervious fabric layer 24 without accumulation of liquid within brick deck overlay system 10. Additionally, it is to be noted that through the adhesive bonding of liquid pervious layer 24 to upper surfaces 22, there is less exposed area of wooden slats 20 to the external atmosphere, which further provides increasing resistance to weather or other external environment deterioration of slat members 20.

Liquid pervious layer 24 in its preferred embodiment composition, is formed of a geosynthetic material composition well known in the commercial marketplace for external environment uses. In broad concept, liquid pervious layer 24 may be a textile fabric having enhanced resistance to external environment conditions.

Geosynthetic layer 24 may be one of a number of commonly used and commercially available woven and nonwoven fabrics used for embankment and/or erosion control. Such useable layers 24 may be of the woven type such as layer #2090 manufactured and sold by Amoco Fabrics and Fibers Co. of Atlanta, Ga. Other nonwoven fabrics sold under the trademark Armopave by Amoco Fabrics and Fibers Co. may also be useable.

Overlay brick deck system 10 further includes brick or tile members 26 which as shown in FIGS. 1, 2 and 4–6 are in contiguous contact with liquid pervious layer or geosynthetic layer 24. Brick or tile members 26 are positionally located adjacent each other in overlying relation with respect to liquid pervious layer 24. As can be seen, brick or tile members 26 are provided with upper surface 28 which when brick members 26 are positionally located each to the other, define a substantially horizontal plane, much in the manner of a base surface of prior art decks. Brick or tile members 26 are positionally located adjacent each other but generally not in contiguous contact in order to permit liquid drainage therethrough. In general, brick or tile members 26 may have a gap between adjacently located members in the approximate range of 1/16–⅛ inches.

Due to the fact that brick members and tile members generally have a high density, the use of a plurality of brick or tile members 26 in a deck system of the nature herein described, provides for a high stress load applied to the overall structure. In order to maintain a structurally secure system which allows for acceptance of loads, there is a necessity to lessen the weight of individual brick or tile members 26. In order to lower the overall weight, brick members 26 are provided with hollowed out lower surface 30, as is clearly seen in FIGS. 1–6. Hollowed out lower surface 30 defines internal chamber 32 for each of brick or tile members 26. Each of brick members 26 provides for lower rim surface 34 which extends substantially throughout a periphery of brick member 26 and provides for interface with geosynthetic or liquid pervious layer 24, as is shown. In this manner, lower rim surface 34 of brick or tile members 26 contiguously interface with liquid pervious layer 24 to provide an overall overlay brick deck system 10, as is seen in FIG. 1.

Brick members 26 may be formed of a number of brick-like compositions. One such composition is a dry cast paving stone manufactured by Balcon, Inc. of Crofton, Md. Typical overall outside dimensions of such brick members 26 are a height approximating 3⅛" with an approximate width of 4.0 inches and a length of approximately 8.0 inches. Elements 26 may be formed of concrete units corresponding to lightweight aggregates as defined by ASTM standards.

Internal chamber 32 of brick members 26 define an internal chamber closed by brick member lower surface 30 and geosynthetic fabric layer 24.

As is seen in FIGS. 2, and 4–6, brick or tile members 26 adjacently mounted each to the other are particularly contoured to provide recesses 36, 36', 36", and 36"', as shown respectively in FIGS. 2, 4, 5 and 6. Recesses 36, 36', 36", and 36"' are at least partially filled with granulated composition 38 to allow moisture to pass therethrough. Granulated composition 38 may be formed of a silicon dioxide composition such as sand, or some like granulated composition which will allow moisture impinging upon the upper surfaces of brick members 26 to pass therethrough into liquid pervious layer 24 and then ultimately through passages 40 to ground 12.

Figure 2:
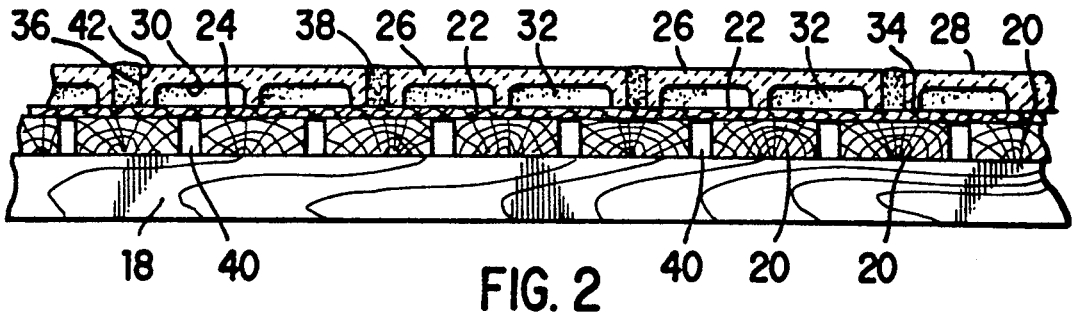
FIG. 2 is an elevational view of a preferred embodiment of the overlay brick deck system showing the liquid pervious layer sandwiched between wooden slat members and overlying brick or tile members.

As shown in FIG. 2, recess 36 formed between adjacently located and positioned brick or tile members 26 is defined by brick members 26 having substantially vertically directed sidewalls 42 passing in a vertical plane. In this configuration, brick members 26 are displaced each from the other for insert of granulated composition 38, as is shown.

Figure 5:
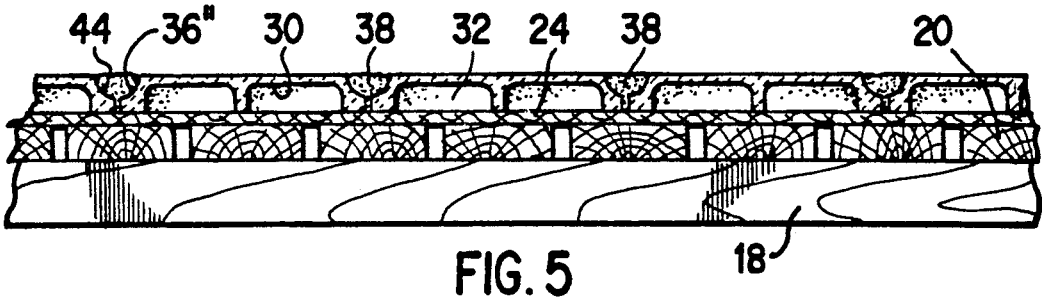
FIG. 5 is an elevational view of another embodiment of the overlay brick deck system showing an arcuate recess between adjacently located brick members for insert of granulated material composition.

As shown in FIG. 5, brick members 26 define cooperating arcuate recess walls 44 for insert of granulated material 38. In this embodiment, arcuate recess walls 44 do not pass in an arcuate manner throughout the vertical thickness of brick or tile members 26, but do provide cooperation in a mating fashion between arcuate recess walls 44 of adjacent brick members 26 to provide a substantially truncated cylindrical contour.

Figure 3:
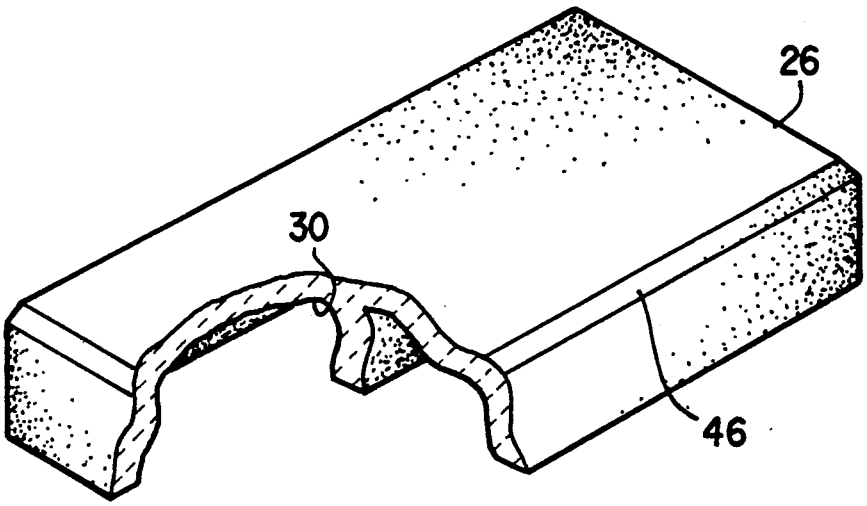
FIG. 3 is a perspective view of one form of a hollowed out brick or tile member.
Figure 4:
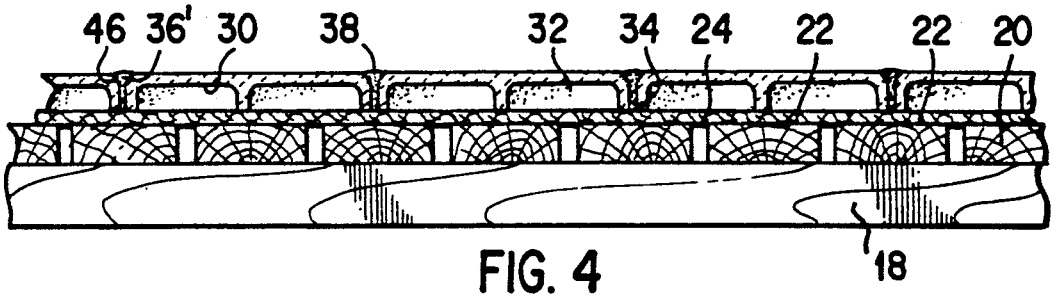
FIG. 4 is an elevational view of an embodiment of the overlay brick deck system showing adjacent brick members having a partial V-shape interfacing recess for insert of granulated material composition.
Figure 6:
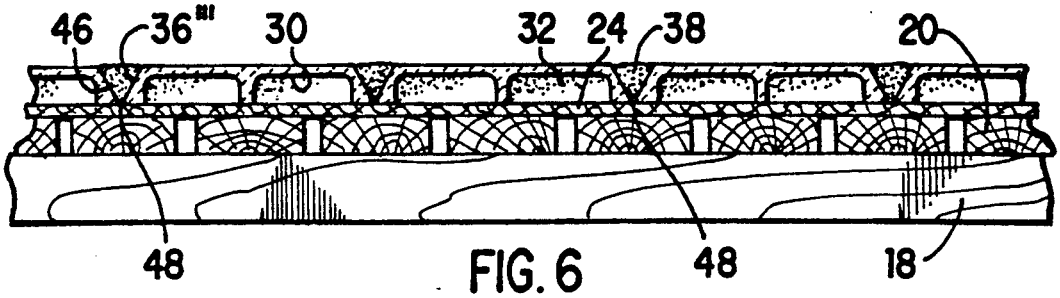
FIG. 6 is an elevational view of a further embodiment of the overlay brick deck system showing a V-shaped recess wall between adjacent brick members for insert of granulated material wherein the V-shaped recess wall has an apex adjacent or contiguous the liquid pervious layer and, FIG. 7 is a bottom plan view of a brick member of the overlay brick deck system.

As shown in FIGS. 3, 4 and 6, adjacently positioned brick members 26 may form V-shaped recess walls 46 for insert of granulated material composition 38. As shown in the FIG. 4 embodiment, the V-shaped recess wall 46 containing granulated composition extends only partially through the vertical thickness of brick member 26. In the embodiment shown in FIG. 6, V-shaped recess wall 46 extends throughout the thickness of the vertical thickness of brick member 26 and provides for apex 48 aligned adjacent liquid pervious layer 24.

Figure 7:
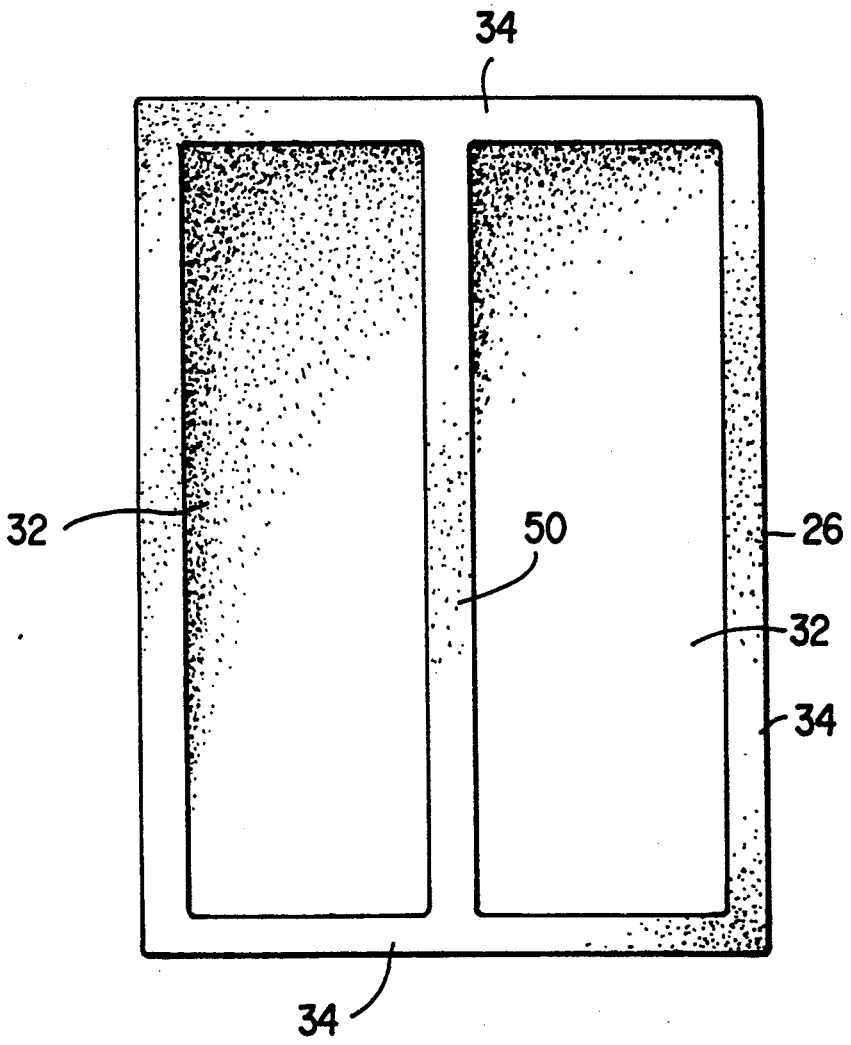

Referring now to FIG. 7, there is shown a lower surface plan view of brick or tile member 26. In this embodiment, internal chamber 32 is formed into opposing chambers 32 interspersed or divided by reinforcing member 50. Reinforcing member 50 may be needed to structurally reinforce brick member 26 under high load bearing conditions. Reinforcing member 50 is coupled to opposing lower rim sections 34 and may be formed of the same composition as brick or tile member 26, or in the alternative, may be merely a rod or other structural reinforcement member 50 which is secured on opposing ends to opposing rim sections 34. In this manner, structural integrity of overall brick or tile members 26 may be increased and provide for a more structurally efficient system.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

What is claimed is:

1. An overlay brick deck system comprising:

(a) a deck base surface formed by an envelope of slat members spaced apart each from another to define openings therebetween;

(b) a liquid pervious layer positionally located in overlying relation with respect to said deck base surface; and, (c) a plurality of brick members positionally located substantially adjacent each to the other in overlying relation with respect to said liquid pervious layer, said plurality of brick members being disposed with recess openings formed therebetween to define a first liquid passageway, said liquid pervious layer defining a second liquid passageway for providing fluid communication from said first liquid passageway to said openings between said plurality of slat members.

2. The brick deck overlay system as recited in claim 1 where said brick members include an upper surface substantially coincident with a horizontal plane.

3. The brick deck overlay system as recited in claim 2 where said brick members include a hollowed out lower surface for providing a lower rim surface extending substantially throughout a periphery of said brick members.

4. The brick deck overlay system as recited in claim 3 where said lower rim surface of said brick members contiguously interfaces with said liquid pervious layer.

5. The brick deck overlay system as recited in claim 4 where said lower rim surface of said brick member is adhesively bonded to said liquid pervious layer.

6. The brick deck overlay system as recited in claim 4 where said liquid pervious layer is adhesively bonded to said deck base surface.

7. The brick deck overlay system as recited in claim 3 where said hollowed out lower surface of said brick members defines an internal chamber closed by said brick member lower surface and said liquid pervious layer.

8. The brick deck overlay system as recited in claim 3 where said hollowed out lower surface of said brick members includes a reinforcing member for increasing the structural integrity of said brick members.

9. The brick deck overlay system as recited in claim 3 where said recess openings formed between said plurality of brick members being at least partially filled with a liquid pervious granulated composition.

10. The brick deck overlay system as recited in claim 9 where said granulated composition includes silicon dioxide.

11. The brick overlay system as recited in claim 9 where said recess formed between adjacently located brick members is defined by said brick members having vertically directed sidewalls in a vertical plane, said brick members being displaced each from the other for insert of said granulated composition.

12. The brick deck overlay system as recited in claim 9 where adjacently positioned brick members define an arcuately contoured recess therebetween for insert of said granulated composition.

13. The brick deck overlay system as recited in claim 9 where adjacently positioned brick members form a V-shaped recess therebetween for insert of said granulated composition.

14. The brick deck overlay system as recited in claim 13 where said V-shaped recess containing said granulated composition extends substantially throughout a vertical thickness of each of said brick members, said V-shaped recess having an apex adjacent said liquid pervious layer.

15. The brick deck overlay system as recited in claim 13 where said V-shaped recess containing said granulated composition extends only partially through a vertical thickness of said adjacently located brick members.

16. The brick deck overlay system as recited in claim 1 where said liquid pervious layer is formed of a textile fabric composition.

17. The brick deck overlay system as recited in claim 1 where said liquid pervious layer is formed of a geosynthetic fabric composition.

18. The brick deck system as recited in claim 1 where said slat members are formed of wood.

19. An overlay tile deck system comprising:

(a) a deck base defined by a plurality of adjacently located slat members, said plurality of slat members each being disposed in spaced apart relation each from another to define openings therebetween;

(b) a geosynthetic fabric layer mounted in overlying relation to an upper surface of said adjacently located slat members;

(c) a plurality of hollowed out tile members positionally located substantially adjacent each to the other, said geosynthetic fabric layer being sandwiched between said deck base and said hollowed out tile members, said plurality of tile members being disposed in spaced relation one with respect to the others to define a recess therebetween; and, (d) a granulated composition at least partially filling said recess formed between adjacent tile members, said granulated composition being liquid pervious for defining a first water drainage passageway to said geosynthetic layer, said geosynthetic layer defining a second liquid drainage passageway for providing fluid communication from said first water passageway to said openings formed between said slat members.

20. The overlay tile deck system as recited in claim 19 where said hollowed out tile members define an internal chamber for lowering the weight of said tile member.

21. The overlay tile deck system as recited in claim 20 where said internal chamber is divided by at least one reinforcing member extending from one side of said tile member to an opposing side.

* * * * *